US009366515B2

(12) United States Patent
Thomas et al.

(10) Patent No.: US 9,366,515 B2
(45) Date of Patent: Jun. 14, 2016

(54) EXPLOSIVE DEVICE AND MINI DEPTH CHARGE GRENADE

(71) Applicant: Lockheed Martin Corporation, Grand Prairie, TX (US)

(72) Inventors: Toby D. Thomas, Southlake, TX (US); Jonathan H. Record, Grand Prairie, TX (US); Kenneth W. Havens, Crowley, TX (US); David L. Hunn, Kennedale, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 360 days.

(21) Appl. No.: 13/857,579

(22) Filed: Apr. 5, 2013

(65) Prior Publication Data

US 2014/0338555 A1 Nov. 20, 2014

Related U.S. Application Data

(60) Provisional application No. 61/620,684, filed on Apr. 5, 2012.

(51) Int. Cl.

| | |
|---|---|
| ***F42B 12/36*** | (2006.01) |
| ***F42B 21/00*** | (2006.01) |
| ***F42C 5/00*** | (2006.01) |
| ***F42C 3/00*** | (2006.01) |
| ***F42B 27/00*** | (2006.01) |

(52) U.S. Cl.

CPC ..... *F42B 21/00* (2013.01); *F42B 12/36* (2013.01); *F42C 3/00* (2013.01); *F42C 5/00* (2013.01); *F42B 27/00* (2013.01)

(58) Field of Classification Search

CPC ..... F42B 21/00; F42B 12/00; F42B 12/02; F42B 12/20; F42B 12/201; F42B 12/36; F42B 27/00; F42B 30/04; F42B 30/08; F42C 3/00; F42C 5/00; F42C 9/08; F42C 9/10; F42C 14/04

USPC ..... 102/390, 391, 392, 408

See application file for complete search history.

(56) References Cited

U.S. PATENT DOCUMENTS

| | | | | | |
|---|---|---|---|---|---|
| 1,314,413 | A * | 8/1919 | Martena | F42B 21/00 | 102/391 |
| 3,199,454 | A * | 8/1965 | Hart | A01K 79/02 | 102/367 |
| 3,537,397 | A * | 11/1970 | Smith | F42B 4/26 | 102/334 |
| 4,188,884 | A * | 2/1980 | White | F42B 12/50 | 102/399 |
| 8,387,535 | B1 * | 3/2013 | Guirguis | F42B 1/00 | 102/315 |

FOREIGN PATENT DOCUMENTS

| | | | | |
|---|---|---|---|---|
| GB | 191508589 | A * | 2/1916 | F42B 21/00 |

* cited by examiner

*Primary Examiner* — James S Bergin

(74) *Attorney, Agent, or Firm* — Terry M. Sanks, Esq.; Beusse Wolter Sanks & Maire, PLLC

(57) ABSTRACT

An explosive device contains a water-reactive material that ignites upon exposure to water. The water-reactive material ignites a water-activated fuse that has a predetermined burn rate and length. The predetermined burn rate and length allows the device to sink to a desired depth before exploding. Hence, the device explodes after a desired period of time and/or at a desired depth. Defense against underwater swimmers is an advantageous feature of embodiments of the disclosure. The device can use a forty millimeter (40 mm) form factor, which permits launch of the device from convention grenade launchers.

19 Claims, 2 Drawing Sheets

EXPLOSIVE DEVICE AND MINI DEPTH CHARGE GRENADE

CROSS REFERENCE TO RELATED APPLICATIONS

This patent application claims the benefit of U.S. Provisional Patent Application No. 61/620,684, filed Apr. 5, 2012, entitled "Explosive Device and Mini Depth Charge Grenade," the teachings and disclosure of which are hereby incorporated in their entireties by reference thereto.

TECHNICAL FIELD

The present disclosure relates generally to an explosive device and, in particular embodiments, to a launchable depth charge device for, e.g., counter against hostile underwater swimmers.

BACKGROUND

When hostile underwater swimmers are detected near a Navy vessel, several defense options may be considered. However, many of these defense options are ill-suited to provide a suitable defense of the vessel. For instance, small arms fire will not penetrate more than two to four feet of water with any lethal force. In addition, the vessel or ship may be in water of insufficient depth to use standard depth charges. Heavy platform mounted weapons may not be capable of being directed to suppressed elevations. Also, hand thrown grenades may not be capable of being thrown far enough or accurately enough to counter the attack. Standard forty millimeter (40 mm) grenades are fused for impact detonation and may not hit hard enough in water to detonate or, if they do, will explode at the surface of the water.

What is needed, then, is a device that overcomes the disadvantages of the prior art.

SUMMARY

This concept provides the vessel's defenders the option to fire an explosive device, e.g., a forty millimeter (40 mm) grenade, which is designed to detonate after sinking to a designated depth or after a set amount of time has elapsed through use of a water-activated fuse train. This would enable the defenders to lay an extended defense parameter around the vessel. The concussive effects of the grenade going off at depth would disorient, disable, or kill any hostile underwater swimmers without hazard to the vessel or its defenders.

BRIEF DESCRIPTION OF THE DRAWINGS

For a more complete understanding of the present disclosure, and the advantages thereof, reference is now made to the following descriptions taken in conjunction with the accompanying drawing, in which.

DETAILED DESCRIPTION OF ILLUSTRATIVE EMBODIMENTS

The making and using of the embodiments are discussed in detail below. It should be appreciated, however, that the present disclosure provides many applicable inventive concepts that can be embodied in a wide variety of specific contexts. The specific embodiments discussed are merely illustrative, and do not limit the scope of the disclosure.

In one illustrative embodiment, the depth charge device is realized as a 40 mm grenade fired from a M203 or M320 grenade launcher. Other grenade launchers, such as M79 launchers and MK19 and MK47 automatic grenade launchers could be employed as well, in other embodiments. The grenade has been designed to detonate after sinking to a designated depth or after a set amount of time has elapsed. This device will enable the defenders to lay an extended defense parameter around a vessel (a.k.a., ship, boat, water vehicle, etc.). The concussive effects of the grenade going off at depth would disorient, disable, or kill any hostile underwater swimmers without hazard to the vessel or its defenders.

Figure 1:
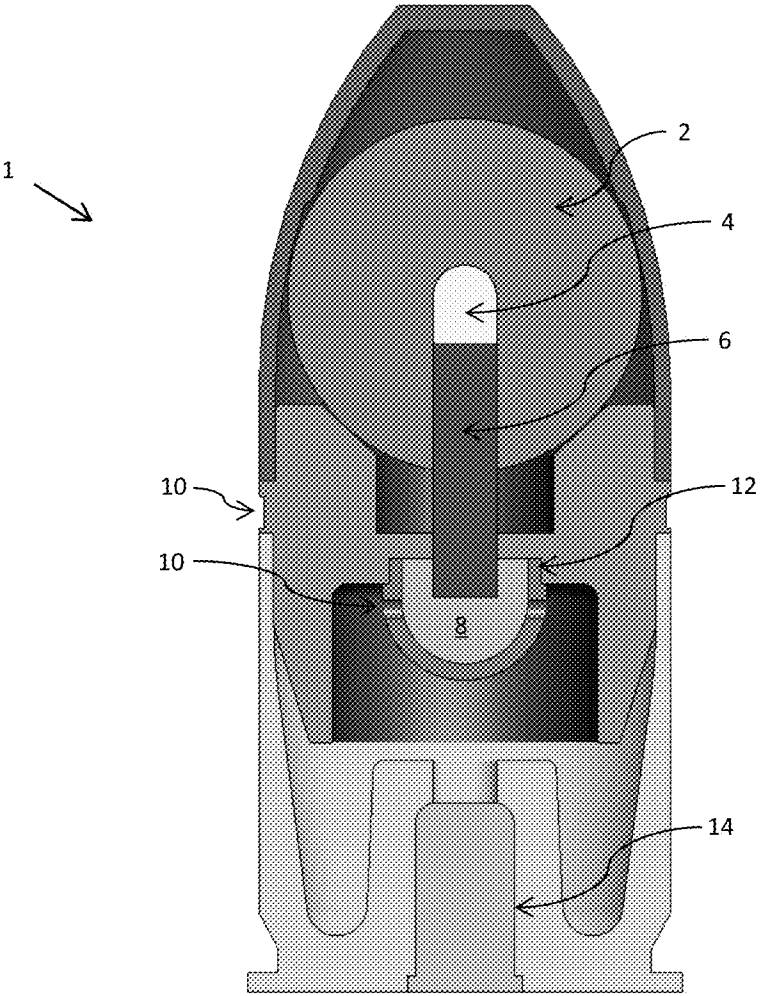
FIG. 1 is a cross-sectional view of an embodiment depth charge device.

An illustrative device 1 is illustrated in FIG. 1. In an illustrative embodiment, the explosive device is implemented in a forty millimeter (40 mm) grenade form factor. Such a form factor allows the device to be launched from a standard grenade launcher without modification or without substantial modification. In one embodiment, device 1 includes a payload of high explosives 2 such as Trinitrotoluene (or more specifically, 2,4,6-trinitrotoluene, which is commonly known as TNT), Composition B explosive, Pentaerythritol tetranitrate (PETN), HMX (a.k.a., octogen), nitrocellulose, and the like.

Device 1 includes one or more vents or openings 10 in the outer casing (a.k.a., shell, jacket, etc.). These openings 10 (sometimes referred to as ports) allow water to enter the interior of the device 1. Upon being launched and landing in water, water passes through opening 10 into a fuse ignition chamber 12. The water reacts energetically with a water-reactive material, such as sodium 8. In an embodiment, the fuse ignition chamber 12 functions as a sodium retaining plug configured to retain the sodium 8 in place.

The reaction of sodium 8 with water ignites fuse train 6. Fuse train 6 (sometimes referred to a fuse train stick) can be designed for a specific burn time. The burn rate of the fuse train 6 allows device 1 to sink a predetermined depth before exploding. When fuse train 6 burns down to detonating charge 4, the detonating charge 4 detonates. Detonation of the detonating charge 4 detonates the high explosive 2. If the water is shallower than the estimated sink distance the device will land on the bottom and will still explode without regard to the depth.

In some embodiments, device 1 has an outer casing or shell that is not water tight, in which case water can flow freely into the casing. In those embodiments, openings 10 in the outer casing are not necessary, but rather, openings 10 may be formed in the chamber 12 in which water-reactive material is contained. In some embodiments, both the outer casing and the chamber 12 holding the water-reactive material have openings for allowing ingress of water. These openings might be the same (i.e., one continuous opening that extends through the outer casing and through the wall of the chamber), or might be discontinuous (i.e. not aligned to one another).

Device 1 also includes primer and propelling charge 14 which are used to launch the device from a launcher. Primer and propelling charge 14 allow device 1 to be fired, e.g., from a M203 or M320 grenade launcher. In other embodiments, device 1 can be fired from a crew served M19 automatic grenade launcher.

An advantageous feature of the illustrative embodiment is that it provides for defense of military or commercial ships and water vehicles, particularly against underwater swimmers. In particular, the blast wave from device 1 in exploding passes through the human body (of a hostile swimmer or combatant) as the human body is of similar consistency to water. Hence, molecules of the human body are displaced very little except in gas spaces capable of compression. Damage is at the gas water interfaces within the body. The gas in the gas filled cavities is instantaneously compressed as the pressure wave passes through the body and the walls of the spaces are torn or shredded as in barotrauma. Damage occurs in the lungs, intestines, sinuses and ear cavities. In the lungs, the damage is not necessarily due to pressure transmitted via the upper airways (as in air blasts) but as a result of transmission of the wave directly through the thoracic wall.

Experiments have demonstrated the efficacy of underwater explosive devices, such as the illustrative embodiments described herein, in disabling or killing enemy combatants. Damage to the respiratory system includes pulmonary hemorrhages at bases, bronchi and trachea, as well as alveolar and interstitial emphysema, and pneumo-haemothorax damage. Intestinal damage includes subserous and submucosal hemorrhage and perforations. Presumably because of the lack of gas cavities, damage to the kidney, bladder, liver and gallbladder is de minimus or non-existent. Studies suggest that if both the thorax and abdomen were immersed in the water in which the explosion occurs, the lungs would be more affected. If only the abdomen were immersed the intestines were most affected, with injury as described above and including rectal bleeding.

Primary causes of death resulting from an underwater explosion of device 1 would include: (1) pulmonary damage (e.g., low arterial $0_2$ saturation ($PaO_2$) hypoxaemia, high arterial $CO_2$ retention ($PaCO_2$) hypercarbia, and respiratory acidosis); (2) brain damage (e.g., petechial hemorrhage and oedema caused by a rapid increase in the venous pressure, following compression of the thoracic and abdominal venous reservoirs by the pressure wave, which causes small blood vessels rupture in the cerebral venous system); and (3) air embolism (e.g., due to the rupture of lung alveoli and the compression of the alveolar gas which enters the pulmonary vein, left ventricle, and cerebro-vascular system causing an air embolism to the brain). Secondary causes of death could include: pulmonary broncho-pneumonia; brain coma; intestinal perforation and peritonitis, as well as other secondary effects of concussion and shock.

For a device 1 that is hand propelled, the provision of primer and propelling charge 14 can be omitted. Likewise, other form factors than the above-described 40 mm grenade are within the contemplated scope of the disclosure.

In some embodiments, a covering (not shown) could be used to cover or protect openings 10 and to prevent accidental discharge of device 10 in the event of exposure to moisture during storage and/or handling. This covering could be removed prior to launching the device or could be designed to peel off or otherwise eject from the device during launch or during flight (e.g., due to the shock of the launch, due to rapid changes in air pressure during launch, due to air friction during flight, and the like). In some embodiments, the covering could be water soluble such that the covering rapidly dissolves upon immersion in water. In still other embodiments, the covering could take the form of water-soluble plugs (not shown) that fill openings 10, but that rapidly dissolves upon contact with water. In some embodiments, such plugs might not be water soluble, but might be designed to evacuate openings 10 upon launch and/or flight.

While sodium has been described as the water-reactive material in an embodiment, those skilled in the art will recognize that other materials, e.g., strontium metal, lithium metal, phosphorous pentachloride, potassium hydroxide, and the like could be used. As a guide, the material should react with water in a controllable manner (i.e. sufficiently violently to ignite fuse train 6, but not so violently as to detonate charge 4). Such a material is generally described herein as a water-reactive material.

Figure 2:
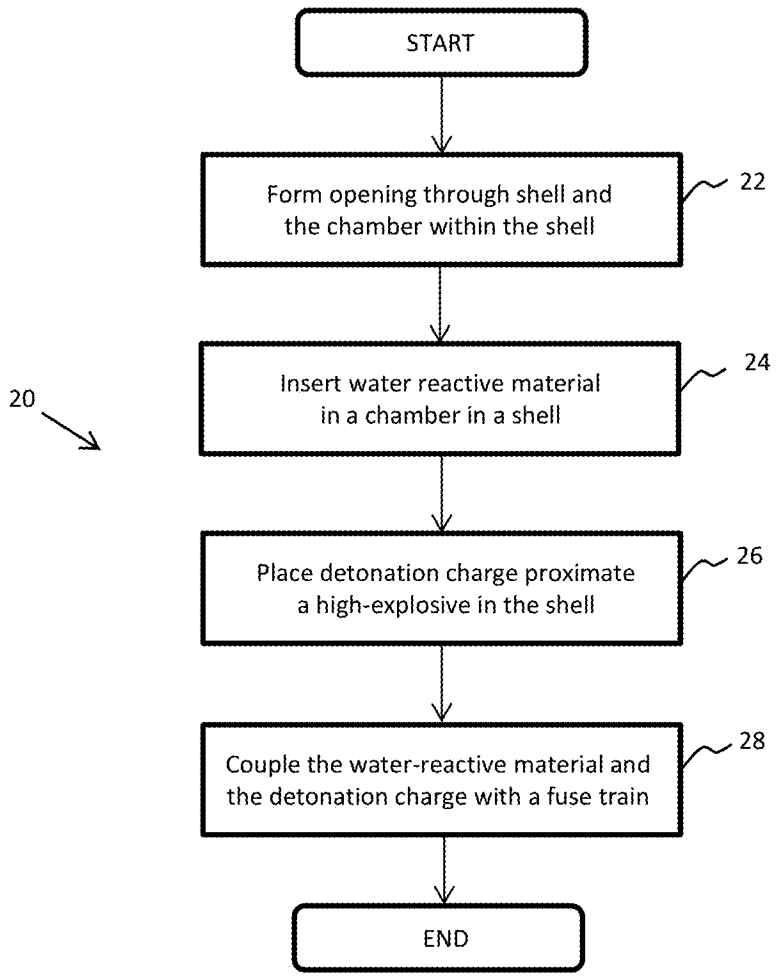
FIG. 2 is a method of constructing an explosive device.

Referring now to FIG. 2, a method 20 of constructing an explosive device is illustrated. In block 22, an opening 10 is formed through a shell and the chamber 12 within the shell 1. As noted above, if the shell has a water soluble casing or otherwise permits water to ingress into the shell, the opening 10 or port may only be needed in the chamber 12 holding and/or supporting the water-reactive material. In block 24, the water-reactive material 8 (e.g., sodium) is inserted within the chamber 12 of the shell 1. In block 26, the detonation charge 4 is placed proximate the high-explosive 2 in the shell 1. Thereafter, in block 28, the water-reactive material 8 and the detonation charge are coupled with the fuse train 6. In an embodiment, the order of the steps in the method 20 may be rearranged, swapped, and so on.

While this disclosure has been made with reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

What is claimed is:

1. An explosive device, comprising:

a shell having a chamber; an opening extending from the chamber through the shell, the shell to house a high explosive;

a water-activated fuse train having a burn rate which is a function of a sink rate of the device and an intended depth of detonation, the water-activated fuse train having a first end and a second end, the first end and the second end being separated by a length of the water-activated fuse train;

a detonation charge within the shell and coupled to the second end of the water-activated fuse train and in proximity to the high explosive; and a water-reactive material within the chamber, the water-reactive material to ignite the water-activated fuse train when exposed to water, the first end of the water-activated fuse train being connected to the water-reactive material, wherein the water-activated fuse train burns down to the detonation charge which is separate from the chamber.

2. The explosive device of claim 1, wherein the water-reactive material is one of sodium, strontium metal, lithium metal, phosphorous pentachloride, and potassium hydroxide.

3. The explosive device of claim 1, wherein the detonation charge is configured to detonate the high explosive within the shell.

4. The explosive device of claim 1, further comprising the high explosive, wherein the fuse train is disposed between the water-reactive material and the high explosive.

5. The explosive device of claim 4, wherein the length corresponds to the intended depth of detonation at which the high explosive will detonate when the water-activated fuse train burns down to the detonation charge.

6. The explosive device of claim 1, further comprising a high explosive within the shell.

7. The explosive device of claim 6, wherein the high explosive is one of TNT, Composition B, Pentaerythritol tetranitrate (PETN), HMX, and nitrocellulose.

8. The explosive device of claim 1, wherein the shell has a forty millimeter (40 mm) grenade form factor.

9. The explosive device of claim 8, further comprising a primer and a propelling charge within the shell.

10. The explosive device of claim 8, further comprising a removable cover to cover the opening in the shell, wherein the removable cover is a peel-off cover.

11. The explosive device of claim 1, wherein the opening is a continuous opening extending from within the chamber to outside of the shell.

12. The explosive device of claim 1, wherein the shell is otherwise water tight, but for the opening.

13. The explosive device of claim 1, wherein the chamber comprises a retaining plug configured to retain the water-reactive material in place.

14. The explosive device of claim 1, wherein the explosive device to produce concussive effects at the intended depth which would cause injury to a hostile underwater swimmer near a vessel without hazard to the vessel.

15. A system for defending a water-borne vehicle, comprising:

a small arms launch device; and an explosive device configured to be launched from the small arms launch device, the explosive device including:

an outer casing having a fuse ignition chamber within the outer casing;

a port to allow ingress of water from outside of the outer casing to within the fuse ignition chamber;

a detonator;

a water-activated fuse train having a first end and a second end being separated by a length of the water-activated fuse train to ignite the detonator connected to the second end of the water-activated fuse train, the water-activated fuse train having a burn rate which is a function of a sink rate of the device and an intended depth of detonation of the detonator; and a water-reactive material within the fuse ignition chamber and connected to the first end of the water-activated fuse train, the water-reactive material to ignite the water-activated fuse train when exposed to water wherein the water-activated fuse train burns down to the detonator which is separate from the fuse ignition chamber.

16. The system of claim 15, further comprising a payload within the outer casing and configured to be detonated by the detonator, wherein the payload is an explosive.

17. The system of claim 15, wherein the small arms launch device is selected from the group consisting of an M203 grenade launcher, an M320 grenade launcher, an M79 launcher, an MK19, and an MK47 grenade launcher.

18. The system of claim 15, wherein the explosive device further comprising a removable cover to cover the port.

19. The explosive device of claim 15, wherein the explosive device to produce concussive effects at the intended depth which would cause injury to a hostile underwater swimmer near a vessel without hazard to the vessel.

* * * * *